United States Patent [19]

Charmes et al.

[11] Patent Number: 4,626,659

[45] Date of Patent: Dec. 2, 1986

[54] ELECTRIC INFRA-RED RAY GENERATOR CONSTITUTING ATMOSPHERE PURIFIER

[75] Inventors: Michel Charmes; Yves Trambouze, both of Lyons, France

[73] Assignee: Ateliers Deconstruction Industrielles du Rhone (A.C.I.R.), Sathonay Camp, France

[21] Appl. No.: 679,334

[22] Filed: Dec. 7, 1984

[30] Foreign Application Priority Data

Dec. 12, 1983 [FR] France ..... 83 20081

[51] Int. Cl.[4] ..... H05B 3/44

[52] U.S. Cl. ..... 219/343; 422/122; 55/527; 219/349

[58] Field of Search ..... 55/279, 524, 525, 527; 422/122, 125, 126, 306; 219/343, 342, 347, 349

[56] References Cited

U.S. PATENT DOCUMENTS

| | | | |
|---|---|---|---|
| 2,508,357 | 5/1950 | Ames | 219/347 |
| 2,988,432 | 6/1961 | Long | 422/122 |
| 3,087,041 | 4/1963 | Vonk | 219/347 |
| 3,607,131 | 9/1971 | Williams | 422/122 |
| 4,023,928 | 5/1977 | Haensel | 422/122 |
| 4,164,642 | 8/1979 | Ebert | 219/349 |
| 4,415,533 | 11/1983 | Kurotori | 422/122 |

FOREIGN PATENT DOCUMENTS

| | | | |
|---|---|---|---|
| 0074748 | 3/1983 | European Pat. Off. . | |
| 2446444 | of 1980 | France . | |
| 512167 | 8/1939 | United Kingdom | 219/343 |

*Primary Examiner*—E. A. Goldberg
*Assistant Examiner*—Teresa J. Walberg
*Attorney, Agent, or Firm*—Dowell & Dowell

[57] ABSTRACT

A housing 2 contains at least one emitter 3, 4 of infra-red rays at short wave lengths disposed inside a reflector 5–6. A mat 8 of refractory fibers impregnated with catalyst is disposed in front of each emitter 3, 4, which screen emits longer wave lengths of infra-red rays when heated by the emitters. An emission of infra-red rays over a broad spectrum is therefore obtained. In addition, combustible gases contained in the heated space may be oxidized in contact with the screen 8 if the latter is impregnated with catalyst.

3 Claims, 4 Drawing Figures

ELECTRIC INFRA-RED RAY GENERATOR CONSTITUTING ATMOSPHERE PURIFIER

FIELD OF THE INVENTION

The present invention relates to improvements made to electric generators of infra-red rays.

BACKGROUND AND PRIOR ART

Apparatus of the type in question, which are well known in the art, are made either in the form of a bare filament in a vacuum or not, or coated with refractory material, or in the form of a surface deposit of an electro-resistant material on an electric insulation, so that it is capable of attaining a temperature of between 1000° and 2500° C. by circulation of an electric current. This generator emits infra-red rays of short wave-length, i.e. of which the majority of the emission lies between 0.75 and 3 microns.

Such electric generators are used either for electrical heating or for industrial heating, for example for treating a coating on a support such as a paint with a view to the baking thereof.

It has been observed that the materials to be treated are much more transparent to short infra-red rays which therefore pass through the coating in question, so that it is not treated in all its thickness.

It is also known that, in order suitably to treat the whole thickness of a coating, it is necessary to emit a broad spectrum of infra-red rays, i.e. of which the wave lengths vary from about 0.75 to 10 microns.

OBJECTS OF THE INVENTION

The improvements forming the subject matter of the present invention seek to provide an electric generator of infra-red rays comprising a broad spectrum.

The invention also aims at producing an atmospheric purifier functioning while emitting a broad spectrum infra-red rays.

SUMMARY OF THE INVENTION

To this end, there is associated with a conventional electric emitter placed in front of a reflector, a heat-refractory support possessing a transparency to the infra-red rays emitted by the emitter, said support being elevated to a temperature at which it emits infra-red rays of wave-lengths longer than the rays of the emitter itself.

The refractory support may be coated within its mass or on the surface by an oxidation catalyst, so that, if the heating of objects subjected to the action of the generator according to the invention produces an evaporation of solvent or other inflammable gas, they are oxidized at the level of the catalytic support before they are heated to the temperature of auto-combustion. An electric generator is therefore obtained which may function in an explosive atmosphere and which, by oxidation of the combustible gases in contact with the catalyst, allows a purification of the atmosphere in question.

Of course, this functioning as a purifier also applies to the oxidation of any combustible gas located in the atmosphere being heated.

The accompanying drawings, given by way of example, will enable the invention, the characteristics that it presents and the advantages that it is capable of procuring, to be more readily understood.

DESCRIPTION OF PREFERRED EMBODIMENTS

Figure 1:
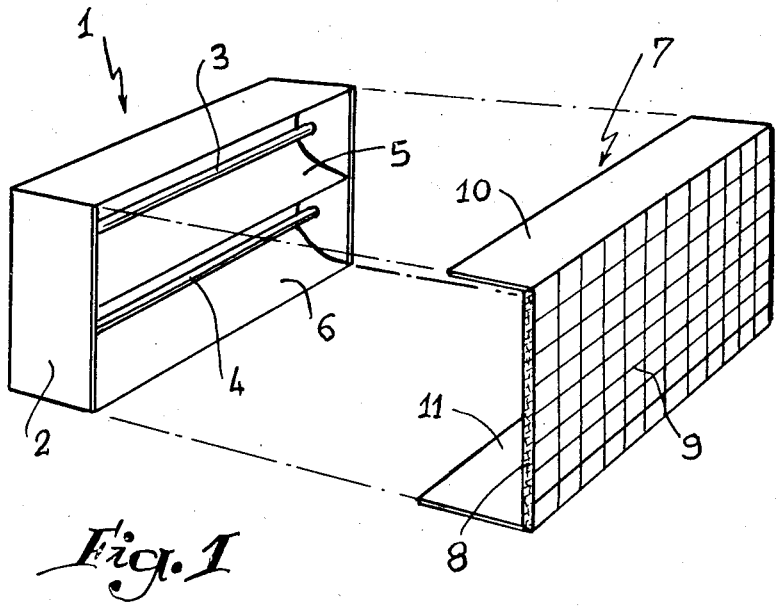
FIG. 1 is an exploded view of an electric generator according to a first embodiment of the invention, the end of the screen being shown in cross-section.

The electric generator of infra-red rays illustrated in FIG. 1 essentially comprises a conventional apparatus 1 formed by a housing 2 in which are located two infra-red ray emitters which have been referenced 3 and 4. These emitters may be made either by means of a filament of tungsten disposed in a quartz envelope in the free air or in a vacuum, or by means of electric lamps, or in the form of an armoured electrical resistance, i.e. composed of a filament coated with magnesia in a metal envelope, or of an electro-resistance deposit covering an electrical insulator. In the example shown, the emitters 3 and 4 are constituted by what is called in the art a quartz tube capable of attaining a temperature of about 2500° C. when it has an electric current passing through its filament. The two emitters are each placed in front of a reflector 5, 6 respectively, of appropriate shape and made of a material presenting the qualities necessary for reflecting the infra-red rays. It is unnecessary to describe in greater detail such an apparatus which may be procured on the market whether it has one or multiple emitters.

Figure 2:
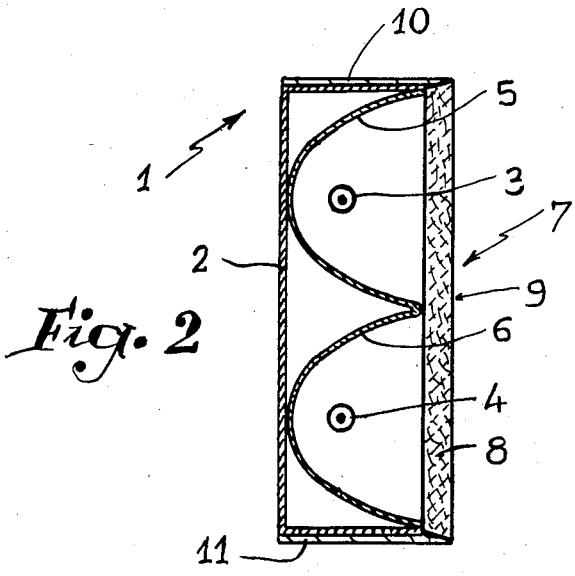
FIG. 2 is a transverse section thereof in the assembled state.
Figure 3:
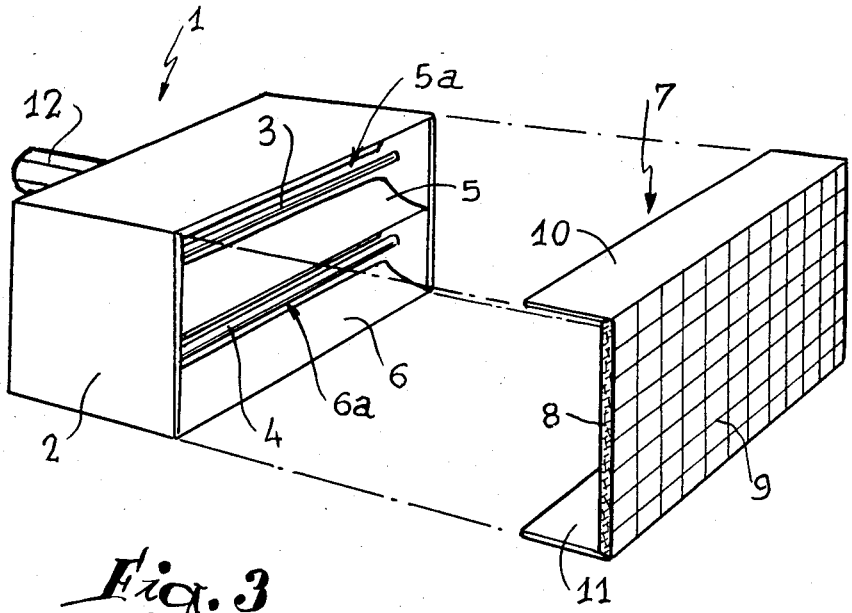
FIG. 3 is a view similar to that of FIG. 1, but illustrating a generator in which the heat-refractory support is impregnated with at least one catalyst.

According to the invention, the housing 2 is protected by means of a heat-refractory support generally referenced 7. This support is established in the form of a screen 8 of refractory material such as for example silica, alumina, zirconium, said screen being in the form of a rectangle of which the dimensions correspond to that of the opening of the housing 2. This screen is bounded by two grids 9 which are supported by flanges 10, 11 which overlap the housing 2 in the manner of a lid, as illustrated in FIG. 2. Of course, the material chosen for making the screen 8 possesses a transparency to the infra-red rays emitted by the emitters 3 and 4.

In fact, said emitters generate infra-red rays of short wave-length, i.e. included between 0.75 and 3 microns (majority of the emission) which pass through the screen 8 whilst heating it so as to increase its temperature very substantially. In this way, the screen 8 is taken to a temperature of between 400° and 1000° C. so that it emits an inherent infra-red radiation of which the wave lengths are longer than those of the emitters 3 and 4. In this way, the addition of the radiation emitted by the emitters and in part passing through the screen 8, and of the inherent longer radiation emitted by the screen, makes it possible to obtain a dissipation of energy radiated over a broad spectrum.

In general, as the material which must be treated is much more transparent to the short infra-red rays than to the long infra-red rays, the first penetrate in the material in question, whilst the second are limited to an action on the surface. The emission of a broad spectrum allows treatment of the whole thickness of the material.

In a second embodiment of the invention, the screen 8 is impregnated on the surface or within its mass with at least one catalyst such as platinum, palladium, nickel, iron, etc . . . or mixture of these metals. Under these conditions, the rise in temperature of the screen 8 due to the short infra-red rays coming from emitters 3 and 4 enables the screen 8 to operate as a veritable catalytic support in contact with combustible gases and vapours contained in the heated atmosphere. Under these conditions, the latter are oxidized by said support and an atmosphere purifier is thus obtained.

To this end, the apparatus is slightly modified and in particular the housing 2 is associated with a conduit 12 terminating in the space 13 located to the rear of the reflectors 5 and 6. The latter comprise longitudinal louvers 5*a*, 6*a* placing in communication the space 13 and the compartments located between each deflector and the screen 8.

Figure 4:
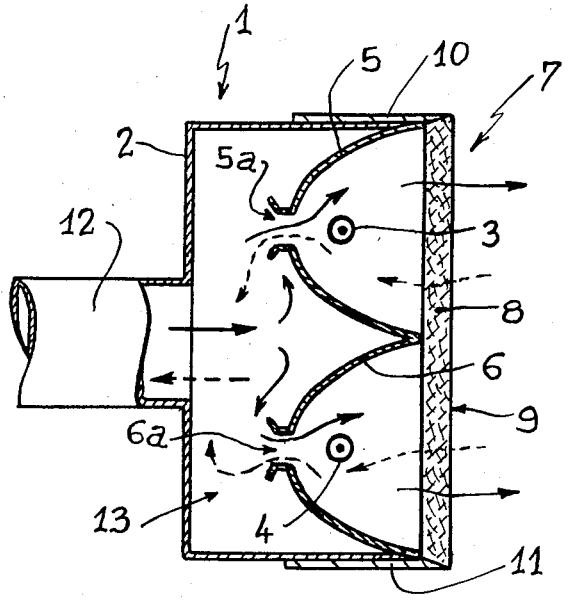
FIG. 4 is a transverse section through an electric generator as illustrated in FIG. 3 in an assembled state.

Of course, the purifier may function by natural convection, i.e. by simple contact of the combustible gases with the catalytic screen or by forced draft as has been shown, i.e. by sucking in the pipe 12 so that the combustible gases and vapours contained in the heated atmosphere pass through the catalytic support in the direction of the broken arrows, FIG. 4. The flow may also be reversed with the same objective, and for obtaining an improved cooling of the source or sources of infra-red rays. In this way, the gases or vapours are sucked with the air contained in the heated atmosphere and sent under pressure in the apparatus in order to pass through the screen from the inside to the outside in the direction of the solid line arrows in FIG. 4.

It must, moreover be understood that the foregoing description has been given only by way of example and that it in no way limits the domain of the invention which would not be exceeded by replacing the details of execution described by any other equivalents.

We claim:

1. An electric infra-red ray generator for safely heating an object in an explosive atmosphere while at the same time oxidizing combustible gases coming in contact with it to purify the atmosphere, comprising:

a supporting housing having an opening and having reflector means in the housing directed toward said opening;

electrical emitter means in the housing between the reflector means and the opening and operative to emit shorter wave-length infra-red rays toward said opening;

a screen of refractory material covering the opening of the housing and receiving said shorter wave-length infra-red rays and being heated thereby, the screen being sufficiently transparent to said shorter infra-red rays to pass a part thereof through the screen toward an object disposed outside the housing, the refractory material of the screen being elevated by the part of the infra-red rays not passed by the screen to a temperature at which the refractory material emits longer wave-length infra-red rays toward said object; and catalytic material impregnating the screen which serves as a support therefor, and the catalytic material being operative when heated with the screen to oxidize combustible gases coming into contact with the screen before they are heated by the emitter means to a temperature of auto-combustion.

2. The electric generator and gas oxidizer as claimed in claim 1 wherein said screen comprises fibers of refractory material supporting said catalytic material, the generator further comprising conduit means communicating with the housing and operative to suck atmospheric gases through the screen to contact the catalytic material impregnating the screen and into the housing in the vicinity of the electrical emitter means.

3. The electric generator and gas oxidizer as claimed in claim 1, wherein said screen comprises fibers of refractory material supporting said catalytic material, the generator further comprising conduit means communicating with the housing and operative to blow atmospheric gases under pressure into the space between the electrical emitter means and the screen so that the gases pass outwardly through the screen.

* * * * *